US006530114B2

(12) United States Patent
Bailey et al.

(10) Patent No.: US 6,530,114 B2
(45) Date of Patent: Mar. 11, 2003

(54) DUST WAND CLEANING APPLIANCE

(75) Inventors: Kevin Bailey, Ottawa (CA); Bjarki Hallgrimsson, Ottawa (CA); Rudy A. Vandenbelt, Ottawa (CA); Troy G. Anderson, Marblehead, MA (US)

(73) Assignee: Headwater Research & Development, Inc., Ottawa (CA)

( * ) Notice: Subject to any disclaimer, the term of this patent is extended or adjusted under 35 U.S.C. 154(b) by 0 days.

(21) Appl. No.: 09/882,782

(22) Filed: Jun. 15, 2001

(65) Prior Publication Data

US 2002/0046437 A1 Apr. 25, 2002

Related U.S. Application Data

(60) Provisional application No. 60/212,188, filed on Jun. 16, 2000.

(51) Int. Cl.[7] ..... A47L 9/00
(52) U.S. Cl. ..... 15/310; 15/319
(58) Field of Search ..... 15/310, 311, 319, 15/DIG. 1, DIG. 9

(56) References Cited

U.S. PATENT DOCUMENTS 1,799,833 A * 4/1931 Swanson ..... 15/311
1,934,144 A * 11/1933 Reiser ..... 15/310
2,031,374 A * 2/1936 Liedtke et al. ..... 15/310
2,033,672 A * 3/1936 Baker ..... 15/310
2,331,457 A * 10/1943 Curtis ..... 15/311
2,475,815 A * 7/1949 Burd ..... 15/310
2,499,183 A * 2/1950 Fairgrieve ..... 15/310
2,519,254 A * 8/1950 Kersky ..... 15/310
2,526,485 A * 10/1950 Kortick ..... 15/310
2,623,230 A * 12/1952 Feinen ..... 15/310
2,625,704 A * 1/1953 Cudy ..... 15/311
2,724,856 A * 11/1955 Conkey ..... 15/310
2,764,776 A * 10/1956 Peguero ..... 15/310
3,217,349 A * 11/1965 Hull et al. ..... 15/311
5,020,186 A * 6/1991 Lessig et al. ..... 15/339
5,230,722 A * 7/1993 Yonkers ..... 55/337
5,265,628 A * 11/1993 Sage et al. ..... 134/103.3
5,655,253 A * 8/1997 Nevin et al. ..... 15/310
6,101,666 A * 8/2000 Cheng ..... 15/310
6,341,402 B2 * 1/2002 Lindquist et al. ..... 15/310

* cited by examiner

*Primary Examiner*—Theresa T. Snider
(74) *Attorney, Agent, or Firm*—Albert Peter Durigon

(57) ABSTRACT

Insertion of a dust wand into a portable vacuum filtration canister removes foreign matter therefrom when and where necessary without polluting the air. A powerpack provides cordless (rechargeable or non-rechargeable) and corded operation. A readily serviceable grid filter, and a HEPA or other filter provides cleaned air free of dirt, dust and allergens.

22 Claims, 7 Drawing Sheets

DUST WAND CLEANING APPLIANCE

This application claims the benefit of No. 60/212,188, filed Jun. 16, 2000.

FIELD OF THE INVENTION

This invention is drawn to the field of brushing, scrubbing and general cleaning, and more particularly, to a novel dust wand cleaning appliance.

BACKGROUND OF THE INVENTION

Dust wands (e.g., feather dusters, lambswool dusters, polyester fiber dusters) and dusting cloths (disposable or reusable) are well-known implements which remove dust and other foreign matter when they are manually wiped across the surfaces of furniture, walls, artifacts and other objects.

Dust wands, particularly lambswool dusters, are reusable implements that are generally effective at dust and foreign matter removal. They typically enjoy a long useful life, but suffer a disadvantage that arises each time their dust collecting agents (fibers or feathers) are periodically cleaned to restore their cleaning power. In the usual case, a rapid back-and-forth movement or spinning action is employed to mechanically shake loose accumulated dust and foreign matter from the wand.

The action of wand cleaning, however, gives rise both to undesirable and often considerable pollution of the air in the vicinity of the dust wand and to an often not inconsiderable accumulation of dirt on the underlying floor and dust on other surfaces in the environment. The polluted air (commonly laden with allergens) is unpleasant to breathe, if not unhealthy, which makes it desirable (although very inconvenient) to clean the wands out of doors even under inclement conditions, while picking up the dirt and dust that accumulate on the floor and elsewhere in the environment requires separate time consuming and often noticeably laborious action.

Disposable dusting cloths are slow to use, expensive, require storage of replacements, are not as efficient to use on delicate objects as dust wands (e.g., wiping a porcelain figurine is more difficult than lightly brushing it with a feather or lambswool duster), and still need to be carried away to the trash increasing the risk that dust will contaminate the air or skin during the process. Reusable dusting cloths are more cost-effective, but suffer the other disadvantages of disposable dusting cloths, plus they need to be washed periodically.

SUMMARY OF THE INVENTION

Accordingly, it is the general object of the present invention to disclose a dust wand cleaning appliance that receives a reusable dust wand in such a way as to conveniently contain its dust collecting agent and provides pollution-less contained removal of dust and foreign matter that may be accumulated thereon. The present invention thereby provides a faster, better, more effective and more convenient, cleaner way of dusting than heretofore thought possible.

The disclosed dust wand cleaning appliance in accord with the present invention includes a canister having an open mouth in communication with an internal chamber adapted to receive a dust wand, and a particulate removal system including an air inlet, an air outlet, a flow passage, a filter and a motor driven vacuum impeller blade so arranged as to draw air through the air inlet past at least a portion of the internal chamber where it entrains any foreign matter that may be present on a dust wand received in the internal chamber and to move the air along the flow passage and into the filter which separates out entrained foreign matter and discharges purified air cleaned of foreign matter through the air outlet.

In the presently preferred embodiments, the dust wand cleaning appliance is portable; the canister is adapted to be free-standing, and the motor of the particulate removal system is powered either by AC, by a rechargeable battery pack, and/or by a non-rechargeable battery pack. Manual and/or automatic (timed or continuous) activation may be employed.

Reusable dust wands may thereby be conveniently cleaned without producing undesirable dirt and dust pollution at the places where they need cleaned and as often as they need cleaned, simply by inserting and removing the dust wand into and out of the canister of the portable dust wand cleaning appliance. When not in use, the reusable dust wands may be conveniently stowed in the free-standing canisters.

In the presently preferred embodiments, the air inlet of the particulate removal system draws air radially outwardly peripherally around a dust wand received in the chamber and an annular comb/dust agitation ring helps dislodge foreign matter from the dust wand. A mesh filter and a HEPA or other high efficiency particulate air type filter are employed to ensure cleaned, allergen-free air.

BRIEF DESCRIPTION OF THE DRAWINGS

These and other objects, inventive aspects and advantageous features of the present invention will become apparent as the invention becomes better understood by referring to the following solely exemplary detailed description of the presently preferred embodiments thereof, and to the drawings, wherein.

DETAILED DESCRIPTION OF THE PRESENTLY PREFERRED EMBODIMENTS

Figure 1:
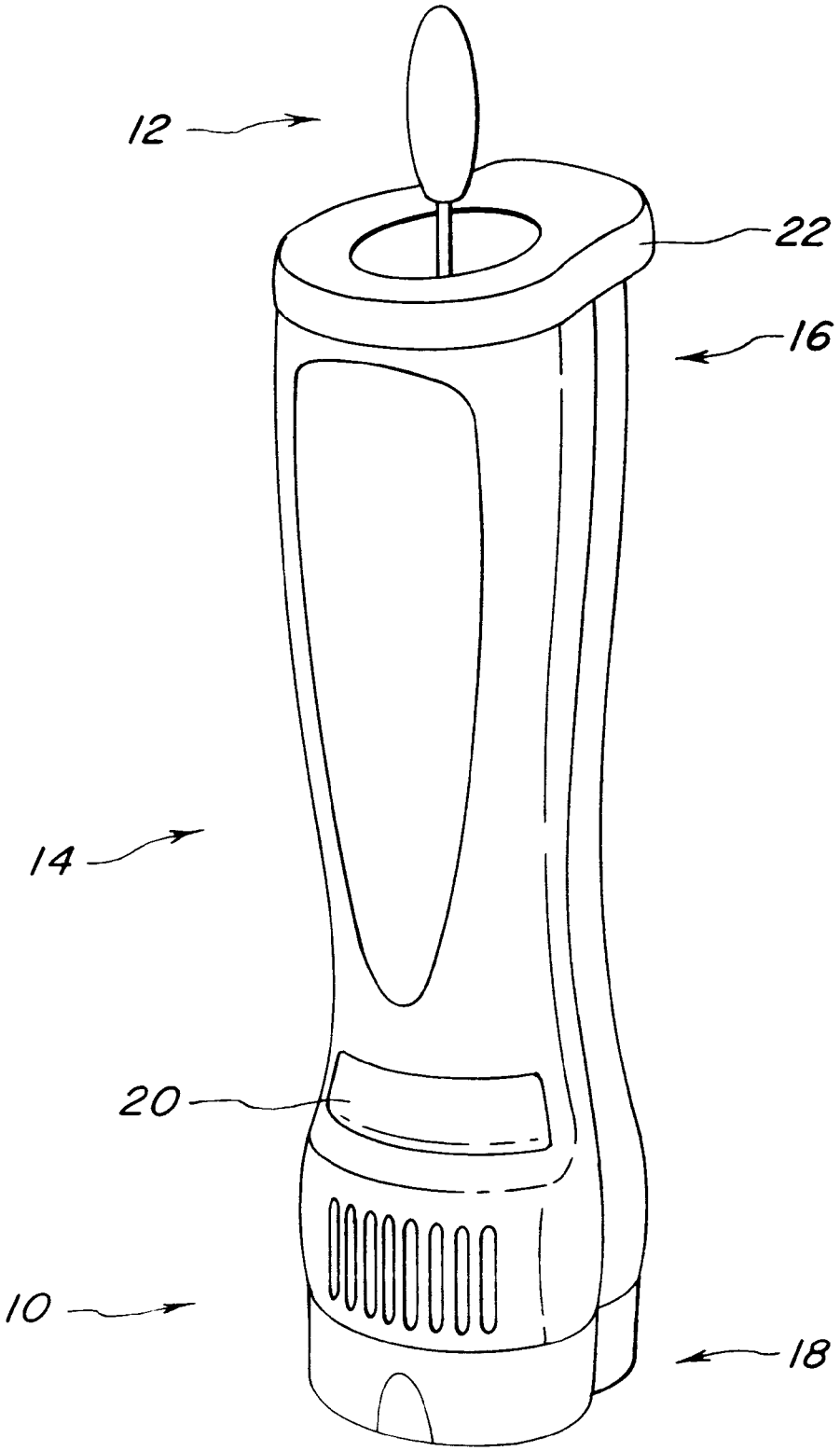
FIG. 1 is a perspective view showing the front and side of one presently preferred embodiment of a dust wand cleaning appliance in accord with the present invention.

Referring now to FIG. 1, generally designated at 10 is a perspective view showing the front and side of one presently preferred embodiment of a dust wand cleaning appliance in accord with the present invention. The appliance 10 receives a reusable dust wand generally designated 12 therewithin and provides contained removal of foreign matter accumulated on the wand.

The appliance 10 includes a canister generally designated 14 having a top and a bottom, a vacuum annulus generally designated 16 mounted at the top of the canister, and a rechargeable battery pack generally designated 18 releasably mounted to the bottom of the canister 14. A drawer 20 slidably mounted through the front of the canister 14 provides access to a HEPA filter for ease of cleaning and filter replacement. A handle 22 laterally extending from the vacuum annulus 16 provides a hand-hold that facilitates relocation of the canister. The appliance 10 is free-standing and portable, provides corded or cordless operation, measures about sixty (60) mm tall and weighs about three and one-half (3.5) kg.

Figure 2:
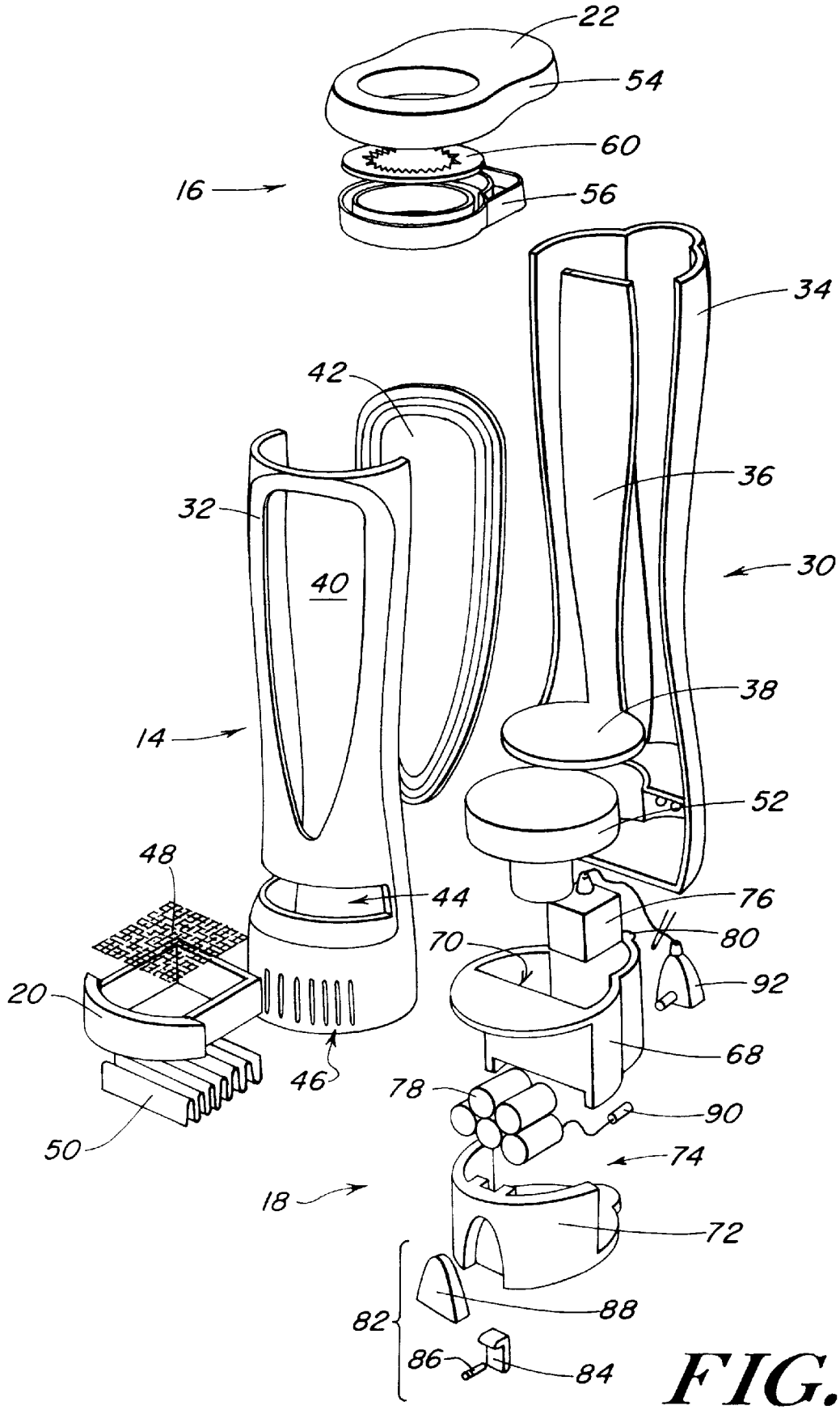
FIG. 2 is a side and front exploded perspective view of the FIG. 1 embodiment of the dust wand cleaning appliance of the present invention.

Referring now to FIG. 2, generally designated at 30 is a side and front exploded perspective view of the FIG. 1 embodiment of the dust wand cleaning appliance of the present invention. The canister 14 includes a front housing shell 32 fastened in air-tight sealing relation to a rear housing shell 34 that together enclose an interior volume. A baffle 36 having a flat-bottom 38 is fastened in air-tight sealing relation to the front and rear housing shells 32, 34. The baffle 36 having the flat-bottom 38 partitions the interior volume into an anterior chamber defined between the inside of the front housing shell 32 and inside faces of the baffle 36 and flat-bottom 38 that opens at the top of the canister 14 and is adapted to receive a dust wand; a subjacent filter and motor receiving cavity defined between the outside face of the flat-bottom 38 and the inside bottom of the mated housing shells 32, 34; and a posterior flow passage defined between the inside of the rear housing shell 34 and the outside face of the baffle 36 that opens, at one of its ends, into the vacuum annulus 16 and at the other of its ends into the subjacent filter and motor receiving cavity.

The front housing shell 32 includes an opening generally designated 40 that extends along the anterior dust wand receiving chamber, to which a translucent window 42 is fastened in air-tight sealing relation; an opening generally designated 44 that confronts the filter and motor receiving cavity, through which the drawer 20 is slidably mounted on alignment and support rails, not shown, provided therefor in the filter and motor receiving cavity; and air outlets generally designated 46. Air outlets, not shown, similar to those on the front housing shell, are provided through the rear housing shell 34.

A plastic (or metal) mesh screen 48 is removably mounted in a tray provided therefor at the top of the drawer 20, and a HEPA (or other filter such as a ULPA or Filtrete) filter 50 is removably mounted in a tray provided therefor at the bottom of the drawer 20. The mesh screen 48 removes comparatively-large particulates, such as hair or dirt, while the HEPA filter 50 removes comparatively-small particulates, such as dust or allergens.

A motor driven vacuum impeller blade 52 is fixedly mounted on support walls, not shown, provided therefor in the filter and motor receiving cavity subjacent the drawer 20. Any suitable means for providing pressure equalization over the area of the filters 48, 50 mounted in the drawer 20 may be employed.

Figure 3:
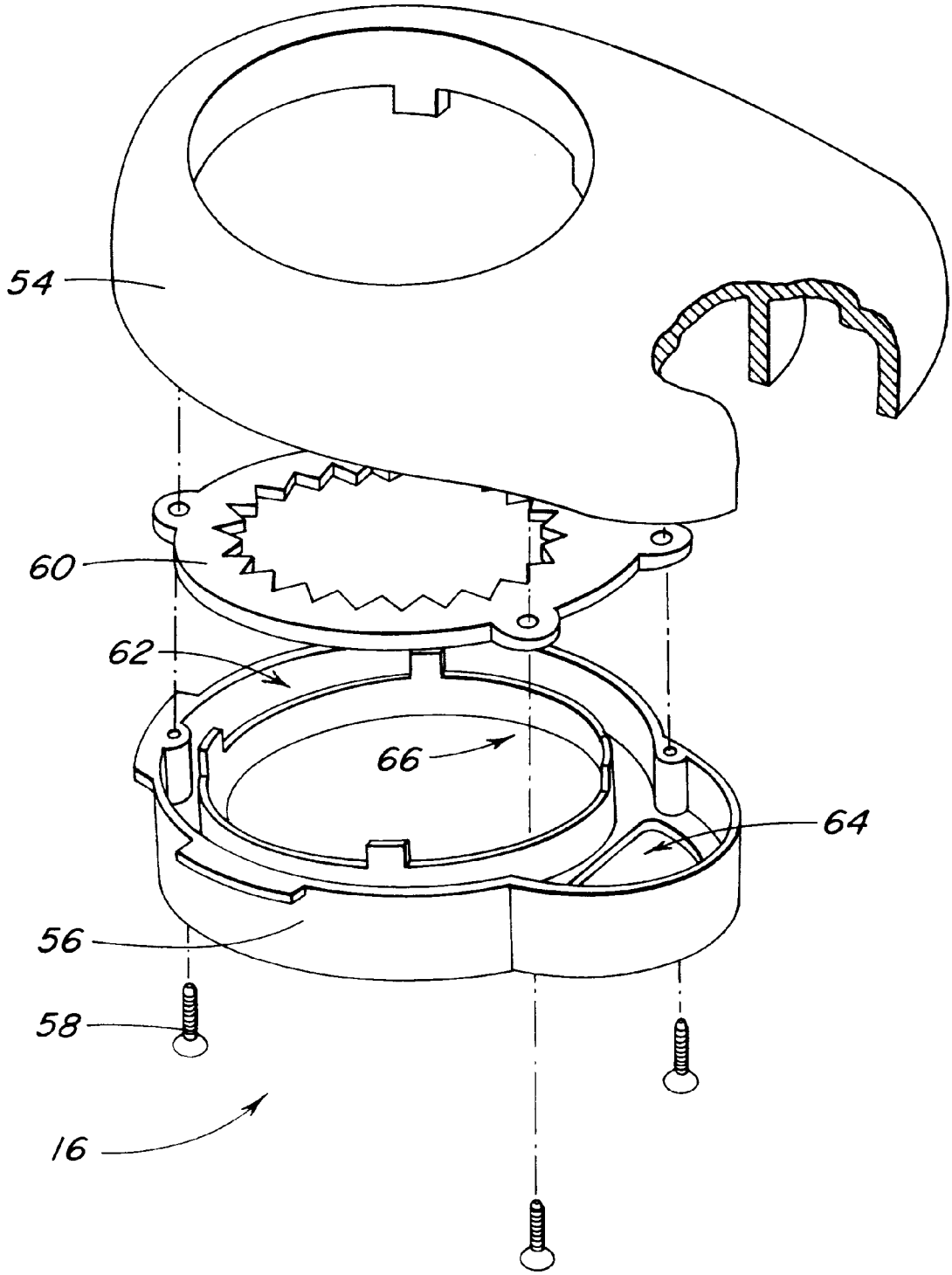
FIG. 3 is an exploded perspective view of a vacuum annulus of the particulate removal system of the embodiment of FIGS. 1–2 of the dust wand cleaning appliance of the present invention.

With reference now to FIGS. 2 and 3, the vacuum annulus 16 will now be described. The vacuum annulus 16, fixedly mounted in air-tight sealing relation at the opening of the top of the anterior dust wand receiving chamber, includes a top split-annulus 54 that is fastened to a bottom split-annulus 56 by threaded fasteners 58 (FIG. 3). An annular comb/dust agitation ring 60 is captured, and secured by the threaded fasteners 58 (FIG. 3), between the top and bottom split-annuluses 54, 56. The annular comb/dust agitation ring 60 mechanically dislodges foreign matter accumulated on dust wands that are passed thereinthrough.

The vacuum annulus 16 defines an annular flow path generally designated 62 (FIG. 3) in communication with a vent generally designated 64 (FIG. 3) that opens to the posterior flow passage in such a way as to provide fluid-tight airflow therebetween. Openings generally designated 66 (FIG. 3) are provided through the inner wall of the annular flow path 62 (FIG. 3) of the vacuum annulus 16 through which air is drawn radially outwardly peripherally about a dust wand received in the anterior dust wand receiving chamber. The openings 66 may be sized and arranged in any suitable manner to provide pressure equalization peripherally about the vacuum annulus 16 so that substantially uniform entrance air velocity is obtained circumferentially about the vacuum annulus.

Returning now solely to FIG. 2, the rechargeable battery pack 18 includes a top housing 68 having a compartment generally designated 70 adapted to receive a transformer that is mounted in snap-fit interlocking relation with a bottom housing 72 having a compartment generally designated 74 adapted to receive one or more rechargeable batteries. A transformer 76, together with its cord, are removably mounted in the compartment 70 of the top housing 68, and five (5) nickel cadmium batteries 78 connected in series are fixedly mounted in the compartment 74 of the bottom housing 72.

The rechargeable battery pack 18 is removably mounted to the bottom of the canister 14 via a hinge tab 80 provided on the top housing 68 that is received in an opening, not shown, provided therefor on the housing shell 34, and spring-loaded latch assembly illustrated by bracket 82 provided on the bottom housing 72 having latch 84, bias spring 86, and release button 88 that cooperate with the hinge tab 80 to releasably mount the rechargeable battery pack 18 to the bottom of the canister 14. Activation of release button 88 moves the latch 84 against the bias provided by spring 86 and disengages it from a catch, not shown, provided therefor on the bottom housing shell 32, whereby the rechargeable battery pack 18 swings on the hinge tab 80 loose of the bottom of the canister 14.

A jack 90 connected to the batteries 78 electrically mates with a jack 92 connected to the transformer 76 that is externally received in a well, not shown, provided therefor on the rechargeable battery pack 18.

When mounted to the canister the rechargeable battery pack supplies power for both corded and cordless operation of the dust wand cleaning appliance of the present invention. For corded operation, the transformer 76 is plugged into a wall outlet, not shown, and power is applied to the motor driven vacuum impeller blade 52 via the mated jacks 90, 92.

Cordless operation is provided by the rechargeable battery pack 18 in one of two modes. In one mode, the transformer 76 is stowed in the compartment 70 of the top housing 68 while the batteries supply power to the motor driven vacuum impeller blade 52, and in the other mode, it is not stowed therein. In the latter mode, the transformer is left plugged into a wall and the user returns the unit to the transformer location for recharging when dusting is completed.

The rechargeable battery pack may be recharged in one of two modes. In one recharging mode, the rechargeable battery pack is recharged while it is connected to the canister, and in the other mode, it may be recharged when it is disconnected from the canister. The removable battery pack allows the user to charge the batteries near an outlet while the duster and dust wand are hung in a closet (or other location) until next use, when the duster and charge base are re-assembled for dusting.

Figure 4:
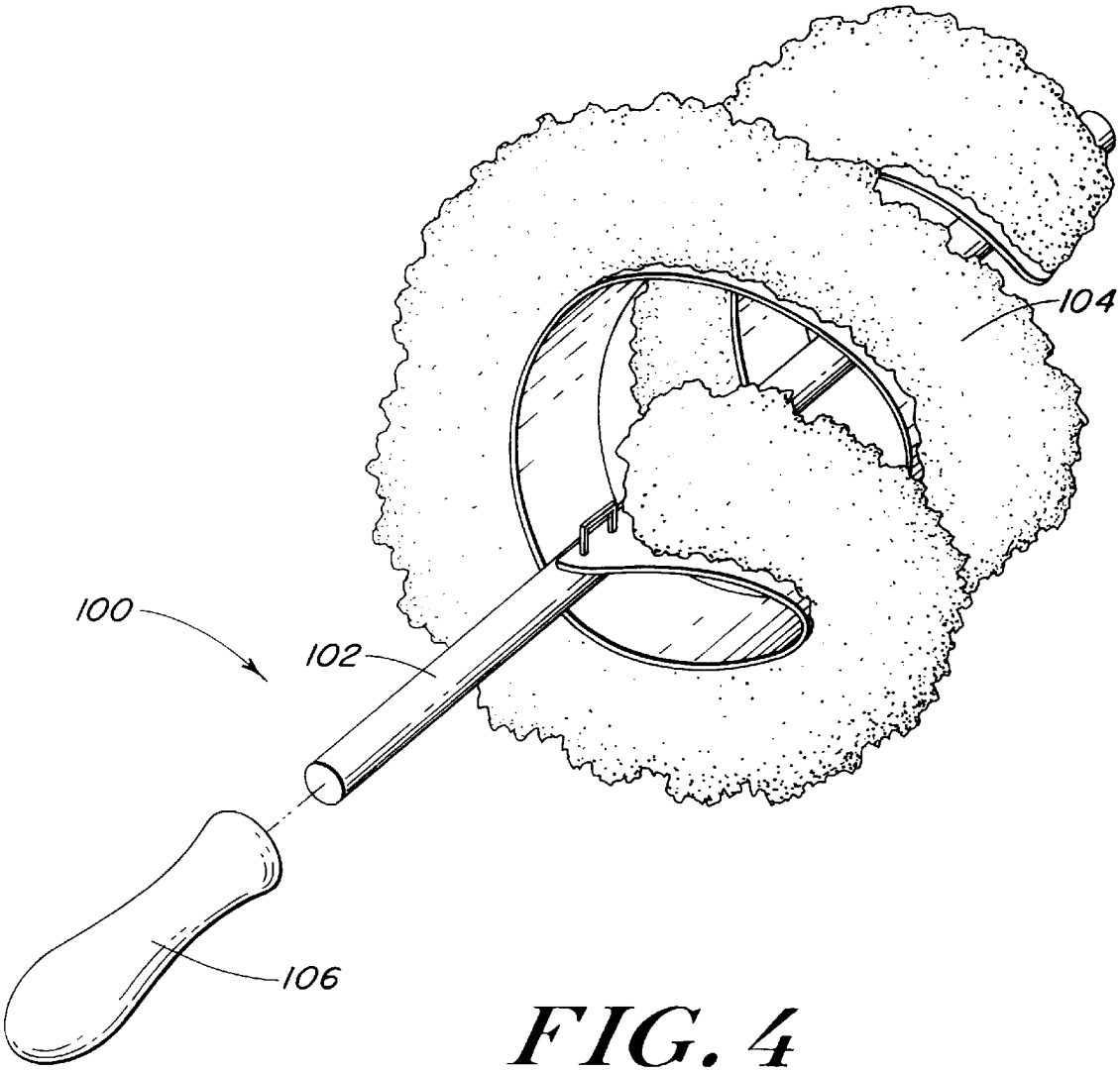
FIG. 4 is a pictorial view of a reusable dust wand suitable for use with a dust wand cleaning appliance of the present invention.

Referring now to FIG. 4, generally designated at 100 is a pictorial view of a reusable dust wand suitable for use with the dust wand cleaning appliance of the present invention. The reusable dust wand 100 includes an elongated rod 102 to which a strip of lamb's wool 104 is stapled at spaced intervals along the length of the rod. A handle 106 is attached to the rod 102. A removable extension handle, not shown, for simple replacement of a dust wand head, or for adding a different wand head (e.g., a ceiling fan cleaning head, a window blind cleaning head, a minihead for cleaning ultra-fine objects, etc.) could be employed. Although a lambswool dust wand is presently preferred, many different varieties of dust wands or dusters are suitable for use with the dust wand cleaning appliance in accord with the present invention.

Figure 5:
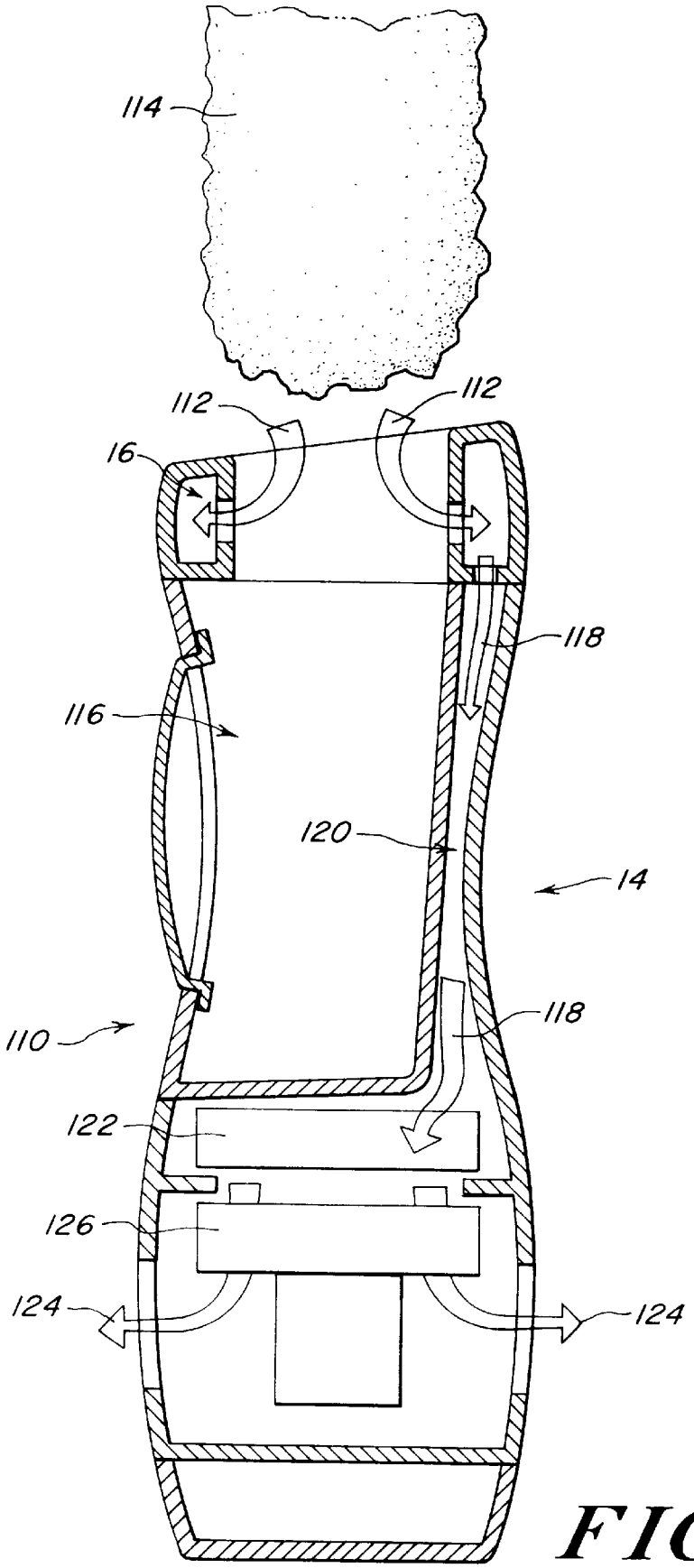
FIG. 5 is a pictorial diagram useful in explaining the operation of the embodiment of the FIGS. 1–3 of the dust wand cleaning appliance of the present invention.

Referring now to FIG. 5, generally designated at 110 is a pictorial diagram useful in explaining the operation of the embodiment of the FIGS. 1–3 of the dust wand cleaning appliance of the present invention. As shown by arrows 112, the vacuum annulus 16 draws air radially outwardly peripherally around the dust wand 100 received in the anterior dust wand receiving chamber generally designated 116 provided therefor in the canister 14. The radially outwardly directed suction provided by the vacuum annulus 16 peripherally around the dust wand 100 cooperates with the mechanical action of the annular comb 60 (FIGS. 2, 3) to dislodge foreign matter off of successive longitudinal portions of the dust wand 100 as it is slidably inserted into and removed from the canister 14 for cleaning. As shown by arrows 118, the air having any entrained foreign matter is drawn through the posterior flow passage generally designated 120 into and through filter 122. The filter 122 separates the entrained foreign matter and discharges purified air cleaned of foreign matter out the air outlets as shown by arrows 124. The motor driven vacuum impeller blade 52 may be either manually actuated or actuated, as by a switch, and/or automatically (timed or continuous) upon dust wand insertion into the canister, as by an IR or other optical, electrical or mechanical sensor system. Visual indication of status (operational and/or recharging) may be provided.

Figure 6:
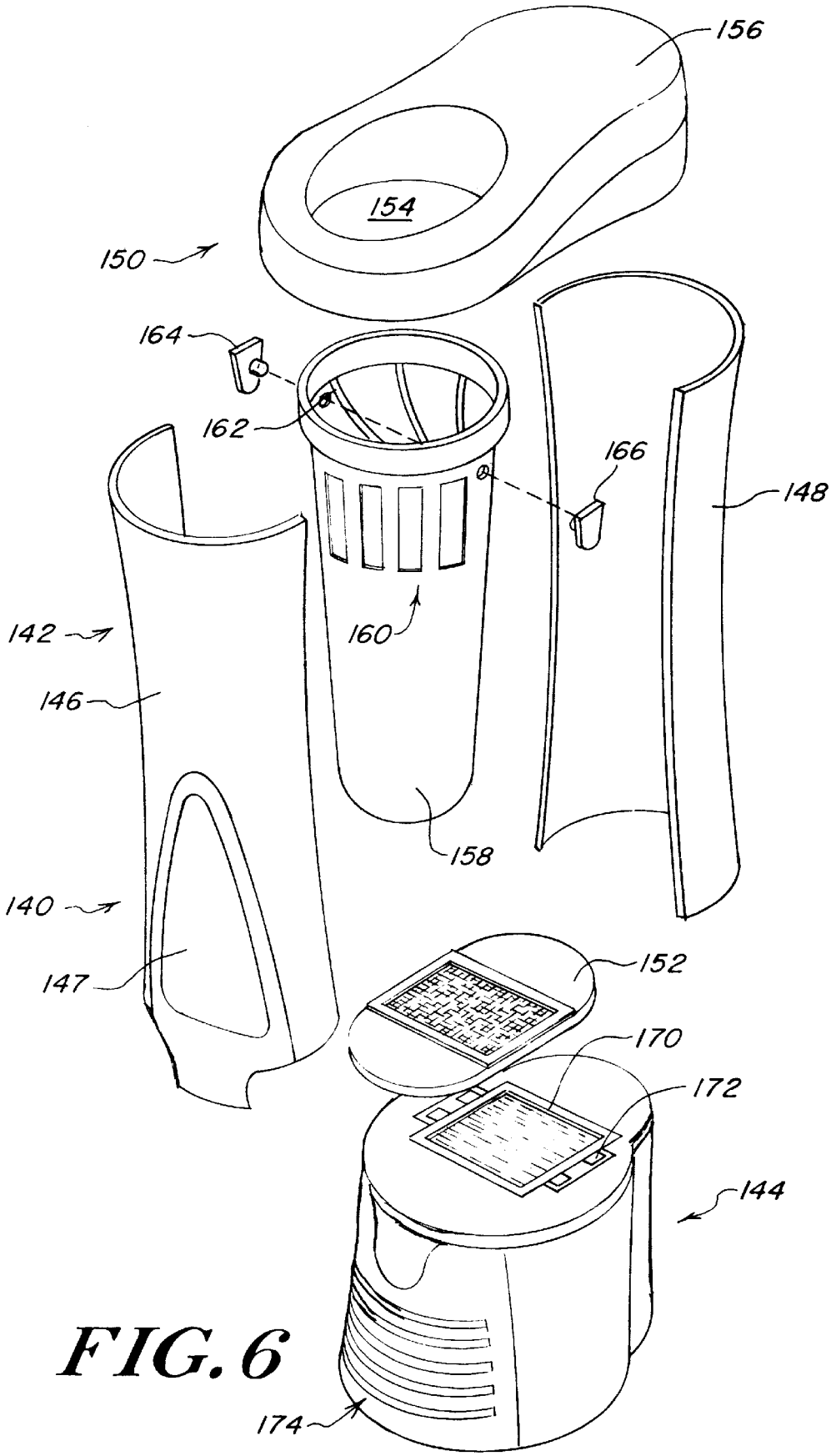
FIG. 6 is a side and front exploded perspective view of another embodiment of the dust wand cleaning appliance of the present invention.

Referring now to FIG. 6, generally designated at 140 is a side and front exploded perspective view of another embodiment of the dust wand cleaning appliance in accord with the present invention. The dust wand cleaning appliance 140 includes a canister generally designated 142 adapted to receive a dust wand to which a base subassembly generally designated 144 is releasably attached. Any suitable means for releasably attaching the cannister and base subassembly such as the spring loaded latch mechanism described above in connection with the description of the embodiment of the FIGS. 1–3 and 5 may be employed.

The canister 142 includes a front housing member 146 having a transparent window 147 fastened in air-tight sealing relation to a rear housing member 148 that enclose an interior volume open at each end. A top subassembly generally designated 150 is fastened in air-tight sealing relation at one open end of the canister 142, and a mesh filter 152 is slidably mounted at the other open end of the canister 142. The mesh filter 152 may be a wire mesh filter having pores adapted to separate comparatively large particles such as dirt or hair.

The top subassembly 150 includes an opening generally designated 154 and a laterally extending handle 156.

A dust wand receiving sleeve 158 having an open mouth is fastened to the top subassembly 150 with its mouth aligned with the opening 154. The outside diameter of the sleeve 158 is less than the inside dimensions of the canister 142 thereby providing an annular flow path therebetween.

The dust wand receiving sleeve 158 includes a plurality of circumferentially spaced-apart elongated slots generally designated 160 proximate the open mouth thereof, and a wire (of metal or plastic) comb/dust agitation ring 162 is slidably mounted in the open mouth of the sleeve 158. The wire comb consists of plural wire filaments whose ends are fastened (or integrally molded) along upper and lower rims at angularly spaced intervals. The wire filaments compress the confronting surface of a dust wand inserted therein-through and mechanically dislodge foreign matter accumulated thereon. The foreign matter is drawn into an area of high suction defined between the wire filaments and the confronting face of the elongated sleeve 158.

An infrared receiver and cooperative infrared emitter 164, 166 are mounted to the sleeve 158. Suction is provided upon interruption of the infrared beam thereby provided by insertion of a dust wand into the sleeve 158 through the mouth 154 of the top subassembly 150 of the canister 142.

The base subassembly 144 includes a HEPA (or other) filter 170 slidably mounted into a recess provided therefor in the top thereof; electrical contacts 172 that mate with electrical contacts, not shown, mounted on the confronting portions of the bottom of the canister 142 operatively connected to the infrared receiver and emitter 164, 166; a motor-driven vacuum impeller blade, not shown, for drawing air through the HEPA filter 170 and discharging it out of air outlets generally designated 174; a printed circuit board, not shown, having infrared switch circuitry; and rechargeable batteries, not shown, operatively connected to the printed circuit board and the motor-driven vacuum impeller blade. A drawer holding a transformer, also not shown, is slidably mounted to the base subassembly 144. As described above in connection with the description of the embodiment of FIGS. 1–3 and 5, the transformer is employed to recharge the rechargeable batteries.

In operation, a dust wand inserted through the opening 154 of the top subassembly 150 interrupts the infrared beam provided by the IR sensors 164, 166, which triggers actuation of the motor-driven vacuum impeller blade. The suction provided thereby draws air through the open mouth 154 circumferentially uniformly through the openings 160 and into the base subassembly 144 via the annular flow path defined between the outside of the sleeve 158 and inside of the canister 142. As the dust wand is slidably received thereinthrough, the wire comb 162 helps to mechanically dislodge foreign matter therefrom, which is entrained in the air stream. Foreign matter entrained in the air stream is separated by the filters 152,170. The filter 152 removes larger matter, such as dirt, and the filter 170 removes smaller matter, such as dust or allergens.

At the time of filter replacement or cleaning, a condition readily evident upon inspection via the transparent window 147, the base 144 is released from the canister 142. Foreign matter accumulated in the bottom of the canister 142 is readily emptied by removing the filter 152, and the HEPA filter 170 may be cleaned or replaced.

Figure 7:
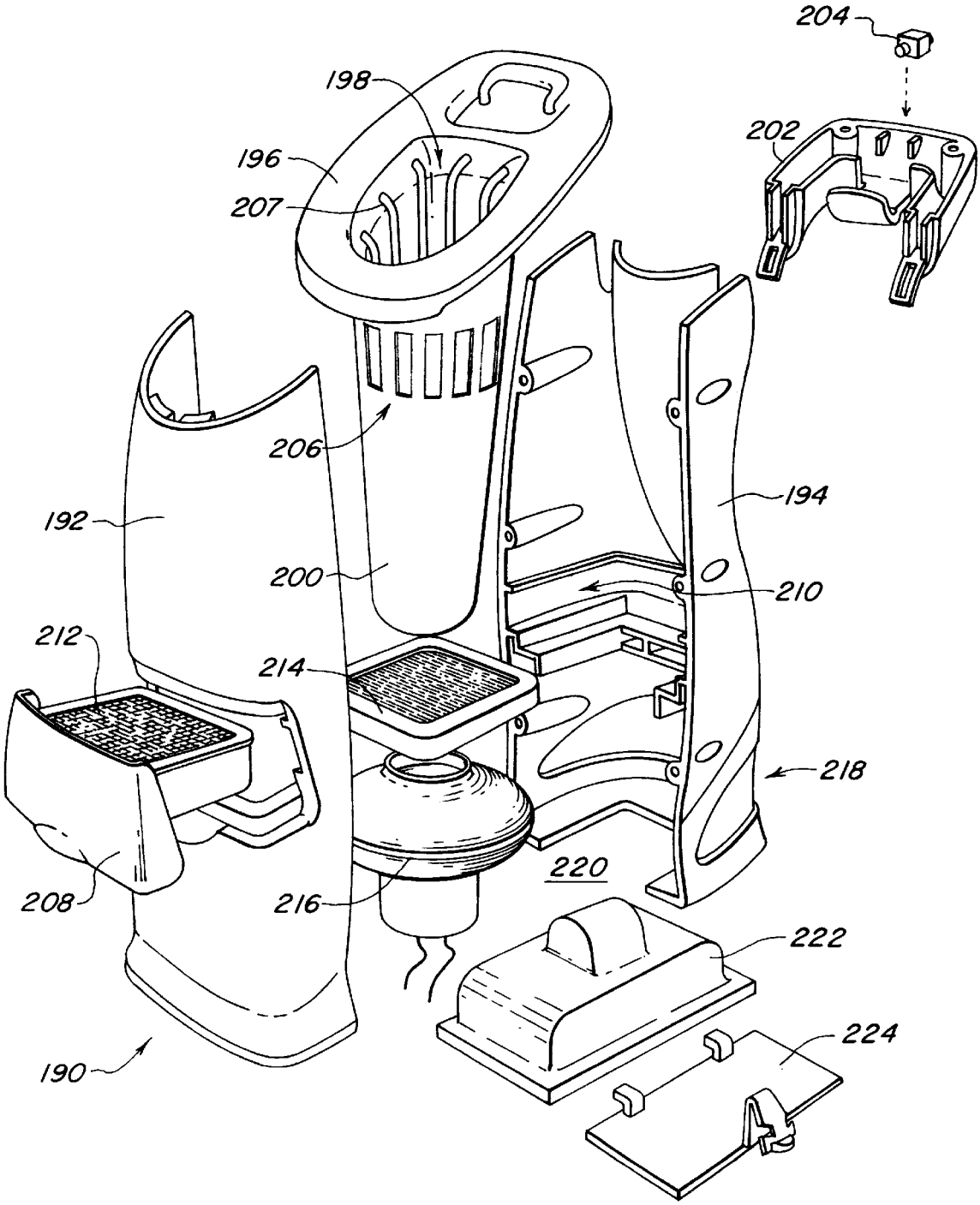
FIG. 7 is a side and front exploded perspective view of a further embodiment of the dust wand cleaning appliance of the present invention.

Referring now to FIG. 7, generally designated at 190 is a side and front exploded perspective view of another embodiment of a dust wand cleaning appliance in accord with the present invention. The dust wand cleaning appliance 190 includes a front housing member 192 fastened in air-tight sealing relation to a rear housing member 194 enclosing an internal volume that opens at the top.

A cover member 196 having an open mouth generally designated 198 in communication with a dust wand receiving sleeve 200 is fastened in air-tight sealing relation to the open top of the members 192, 194, with the hand-hold 202 joining the cover member 196 to the rear housing member 194. The outside diameter of the sleeve 200 is less than the inside dimensions of the members 192, 194 thereby providing an annular flow path therebetween. A manual switch 204 is mounted to the hand-hold 202 in readily accessible position.

The dust wand receiving sleeve 200 includes a plurality of circumferentially spaced-apart elongated slots generally designated 206 proximate the open mouth thereof, and a wire comb/dust agitation ring 207 (plastic or metal) is slidably mounted in the open mouth of the sleeve 200. The wire comb/agitation ring consists of plural wire filaments whose ends are fastened (or integrally formed) along upper and lower rims at angularly spaced intervals. The wire filaments compress the Id confronting surface of a dust wand inserted thereinthrough and mechanically dislodge foreign matter accumulated thereon. The foreign matter is drawn into an area of high suction defined between the wire filaments and the confronting face of the elongated sleeve 200.

A drawer 208 is slidably mounted through the front housing member 192 on guide and support rails generally designated 210 provided therefor on the inside of the housing members 192, 194. A mesh filter 212 and a HEPA filter 214 are removably mounted in the drawer 208. The mesh filter 212 removes comparatively-large material, such as dirt or hair, and the HEPA filter 214 removes comparatively-small material, such as dust or allergens.

A vacuum impeller blade and motor assembly 216 is mounted in the interior volume of the housing members 192, 194 below the drawer 208, and air outlets generally designated 218 are provided through the rear housing member 194.

The housing members 192, 194 are provided with an open bottom generally designated 220, and a battery box 222 is fastened at the bottom of the housing members 192, 194 such that the interior thereof is accessible through the open bottom 220. A battery cover 224 is releasably mounted to the box 222. The battery box 222 receives one or more non-rechargeable batteries.

In operation, upon actuation of the manual switch 204 and insertion of a dust wand through the open mouth 198 of the cover member 196, the vacuum generated by the vacuum impeller blade and motor assembly 216 draws air through the open mouth 198 circumferentially uniformly through the slots 206 and through the filters 212, 214 in the drawer 208 via the annular flow path defined between the outside of the sleeve 200 and inside of the housing members 192, 194. As the dust wand is slidably received thereinthrough, the wire comb/dust agitation ring 207 helps to mechanically dislodge foreign matter therefrom, which is entrained in the air stream.

The foreign matter entrained in the air stream is separated in the filter 212 and filter 214 and cleaned, filtered air is discharged out the air outlets 218. At times of filter cleaning or replacement, the drawer 208 is slidably removed and the filters 212, 214 cleaned or replaced.

Many modifications, variations and embodiments of the presently disclosed invention will become apparent to those of skill in the art without departing from the inventive concepts.

What is claimed is:

1. A dust wand cleaning appliance for cleaning a reusable dust wand to be cleaned, comprising:

first means for receiving at least a portion of the dust wand to be cleaned;

second means cooperative with said first means for removing foreign matter from the dust wand to be cleaned when it is received by said first means;

wherein said first means includes a canister having a chamber adapted to receive the dust wand to be cleaned and said second means includes a motor driven fan, a filter and a power module operatively connected to said motor driven fan that are mounted to said canister;

wherein said canister is provided by mating, interfitting first and second housing bodies and wherein a baffle cooperates with at least one of said first and second housing bodies to provide said chamber; and wherein said second means includes an annulus in communication with a portion of said chamber and an agitation member extending circumferentially radially inwardly about said annulus to provide mechanical agitation of the dust wand to be cleaned when it is received in said chamber.

2. The dust wand cleaning appliance of any one of claim 1, wherein said motor driven fan and said power module are mounted in said canister.

3. The dust wand cleaning appliance of claim 2, wherein said filter is mounted in a drawer slidably mounted to said canister.

4. The dust wand cleaning appliance of claim 3, wherein said filter is a grid filter.

5. The dust wand cleaning appliance of claim 4, wherein said grid filter is a mesh filter.

6. The dust wand cleaning appliance of claim 3, wherein said filter is a HEPA filter.

7. The dust wand cleaning appliance of any one of claim 1, wherein said motor driven fan and said power module are mounted in a housing releasably mounted to said canister.

8. The dust wand cleaning appliance of claim 7, wherein said filter is releasably mounted to said canister at the interface between said canister and said housing.

9. The dust wand cleaning appliance of claim 8, wherein said filter is a mesh filter.

10. The dust wand cleaning appliance of claim 7, wherein said filter is mounted to said housing.

11. The dust wand cleaning appliance of claim 10, wherein said filter is a HEPA filter.

12. The dust wand cleaning appliance of claim 1, wherein said power module includes an AC adapter.

13. The dust wand cleaning appliance of claim 1, wherein said power module includes rechargeable batteries.

14. The dust wand cleaning appliance of claim 1, wherein said power module includes non-rechargeable batteries.

15. The dust wand cleaning appliance of claim 1, wherein said second means further includes a switch.

16. The dust wand cleaning appliance of claim 15, wherein said switch is a manually actuated switch.

17. The dust wand cleaning appliance of claim 15, wherein said switch is automatically actuated upon insertion of the dust wand in said chamber.

18. The dust wand cleaning appliance of claim 17, wherein said automatically actuated switch includes an infrared emitter and detector.

19. The dust wand cleaning appliance of claim 1, wherein said motor driven fan is mounted to said canister and said power module is mounted in a housing releasably mounted to said canister.

20. A dust wand cleaning appliance for cleaning a reusable dust wand to be cleaned, comprising:

a canister having an open mouth in communication with an internal chamber adapted to receive the dust wand to be cleaned; and a particulate removal system including an air inlet, an air outlet, a flow passage, a filter and a motor driven vacuum impeller blade so arranged as to draw air through the air inlet past at least a portion of the internal chamber where it entrains any foreign matter that may be present on the dust wand to be cleaned when it is received in the internal chamber and to move the air along the flow passage and into the filter which separates out entrained foreign matter and discharges purified air cleaned of foreign matter through the air outlet;

wherein said air inlet of said particulate removal system is adapted to draw air radially outwardly circumferentially about at least a major portion of the periphery of the dust wand to be cleaned when it is received in said chamber.

21. A dust wand cleaning appliance for cleaning a reusable dust wand to be cleaned, comprising:

first means for receiving at least a portion of the dust wand to be cleaned;

second means cooperative with said first means for removing foreign matter from the dust wand to be cleaned when it is received by said first means;

wherein said first means includes a canister having a chamber adapted to receive the dust wand and said second means includes a motor driven fan, a filter and a power module operatively connected to said motor driven fan that are mounted to said canister; and wherein said canister is provided by mating, interfitting first and second housing bodies and wherein a dust wand receiving sleeve is mounted to said first and second housing bodies to provide said chamber.

22. The dust wand cleaning appliance of claim 21, wherein said dust wand receiving sleeve is circumferentially slotted about a portion of its length and said second means includes a wire comb/dust agitation ring mounted in said sleeve about said circumferentially slotted portion thereof to provide mechanical agitation of the dust wand received in said chamber.

* * * * *